US006745753B2

(12) United States Patent
Spinnler et al.

(10) Patent No.: US 6,745,753 B2
(45) **Date of Patent: *Jun. 8, 2004**

(54) HIGH-PRESSURE INJECTION SYSTEM

(75) Inventors: Fritz Spinnler, Mellingen (CH); Claudio Zanetti, Eglisau (CH)

(73) Assignee: CRT Common Rail Technologies AG, Neuhausen (CH)

( * ) Notice: Subject to any disclaimer, the term of this patent is extended or adjusted under 35 U.S.C. 154(b) by 202 days.

This patent is subject to a terminal disclaimer.

(21) Appl. No.: 09/977,329

(22) Filed: Oct. 16, 2001

(65) Prior Publication Data

US 2002/0017278 A1 Feb. 14, 2002

Related U.S. Application Data

(63) Continuation of application No. 09/714,188, filed on Nov. 17, 2000.

(30) Foreign Application Priority Data

Nov. 19, 1999 (CH) ..... 2122/99

(51) Int. Cl.[7] ..... F02M 37/04
(52) U.S. Cl. ..... 123/509; 123/456
(58) Field of Search ..... 123/509, 456, 123/495, 446, 447, 508

(56) References Cited

U.S. PATENT DOCUMENTS 4,777,921 A * 10/1988 Miyaki et al. ..... 123/456
5,197,438 A * 3/1993 Kumano et al. ..... 123/506
5,398,658 A * 3/1995 Mesimaki ..... 123/509
5,524,912 A 6/1996 Laub et al.
5,603,303 A * 2/1997 Okajima et al. ..... 123/508
5,678,521 A * 10/1997 Thompson et al. ..... 123/447
5,697,343 A * 12/1997 Isozumi et al. ..... 123/446
6,095,118 A * 8/2000 Klinger et al. ..... 123/446
6,205,980 B1 * 3/2001 Spinnler ..... 123/495
6,330,876 B1 * 12/2001 Spinnler ..... 123/456

FOREIGN PATENT DOCUMENTS

| | | |
|---|---|---|
| EP | 0 915 252 | 5/1999 |
| EP | 0 990 792 | 4/2000 |
| GB | 2 107 801 | 5/1983 |
| JP | 3-41279 | 4/1991 |
| JP | 4-183968 | 6/1992 |
| JP | 7-167009 | 7/1995 |
| JP | 2000-35149 | 2/2000 |
| JP | 2000-110692 | 4/2000 |

* cited by examiner

*Primary Examiner*—Carl S. Miller
(74) *Attorney, Agent, or Firm*—Oblon, Spivak, McClelland, Maier Neustadt, P.C.

(57) ABSTRACT

A high-pressure injection system including a high-pressure pump having a plunger cylinder, the plunger cylinder having a delivery chamber and a high-pressure sealing surface on an outlet side, a port element arranged on the outlet side of the plunger cylinder and having a first end face and a second end face, the port element flow-connected to the delivery chamber and an outlet valve, the first end face of the port element facing the plunger cylinder, and a high-pressure line element arranged on an outlet side of the port element. The high-pressure line element comprises a high-pressure sealing surface. The high-pressure line element bears against the second end face of the port element. The port element is clamped between the plunger cylinder and the high-pressure line element. The first and second end faces of the port element each comprise a high-pressure sealing surface.

21 Claims, 6 Drawing Sheets

S
S
21

III - III
210

35
31
33
15
30
32
25
21
34
III-III 310
330
350
150
300
320
340
250
210
III - III

HIGH-PRESSURE INJECTION SYSTEM

CROSS-REFERENCE TO RELATED APPLICATIONS

The present application claims priority under 35 U.S.C. §119 to Swiss Patent Application No. 1999 2122/99, filed Nov. 19, 1999 and under 35 U.S.C. §120 to a U.S. Application Ser. No. 09/714,188, filed Nov. 17, 2000. The contents of those applications are incorporated herein by reference in their entirety.

BACKGROUND OF THE INVENTION

1. Field of the Invention

The present invention relates to a high-pressure injection system for internal combustion engines.

2. Description of the Background

GB-A-2 107 801 discloses a high-pressure injection system with a high-pressure pump having a plunger cylinder intended for an internal combustion engine, in which the pump delivers a pumped medium through a discharge port provided in a port element to a connection of a pressure line, which can be connected to an injector of the internal combustion engine. The adjacent sides of the high-pressure pump and the port element are designed as high-pressure sealing surfaces, so that the use of sealing elements can be dispensed with.

EP 0 915 252 A2 discloses a common rail injection system, in which a high-pressure pump delivers a pumped medium directly into a pressure chamber provided in the common rail. Injectors, through which the pumped medium stored in the pressure chamber can be delivered to the internal combustion engine, are also inserted into the common rail. In this solution, the plunger cylinder is inserted directly into the common rail, so that the use of a port element can be dispensed with.

SUMMARY OF THE INVENTION

An object of the present invention is to provide a high-pressure injection system, in which a high-pressure pump can be economically and tightly connected to a high-pressure line element. Another object of the present invention is to provide a high-pressure line element that can be used for a high-pressure injection system according to the present invention.

These objects and others can be achieved by providing a high-pressure injection system including a high-pressure pump having a plunger cylinder, the plunger cylinder having a delivery chamber and a high-pressure sealing surface on an outlet side, a port element arranged on the outlet side of the plunger cylinder and having a first end face and a second end face, the port element having an outlet port flow-connected to the delivery chamber and an outlet valve, the first end face of the port element facing the plunger cylinder, and a high-pressure line element arranged on an outlet side of the port element. The high-pressure line element comprises a high-pressure sealing surface. The high-pressure line element bears against the second end face of the port element. The port element is clamped between the plunger cylinder and the high-pressure line element. The first and second end faces of the port element each comprise a high-pressure sealing surface.

Also, the present invention includes a high-pressure line element including a pressure chamber serving for storage of a pumped medium which is fed into the pressure chamber by a high-pressure pump and fed from the pressure chamber to a plurality of injectors inserted into the internal combustion engine, and at least one cylindrical formed-on part configured to be connected to a high-pressure pump and having an admission port and a discharge port. The admission port is configured to feed the pumped medium carried in the high-pressure line element to the high-pressure pump, and the discharge port is configured to receive the pumped medium from the high-pressure pump to the pressure chamber.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE PREFERRED EMBODIMENTS

Figure 1:
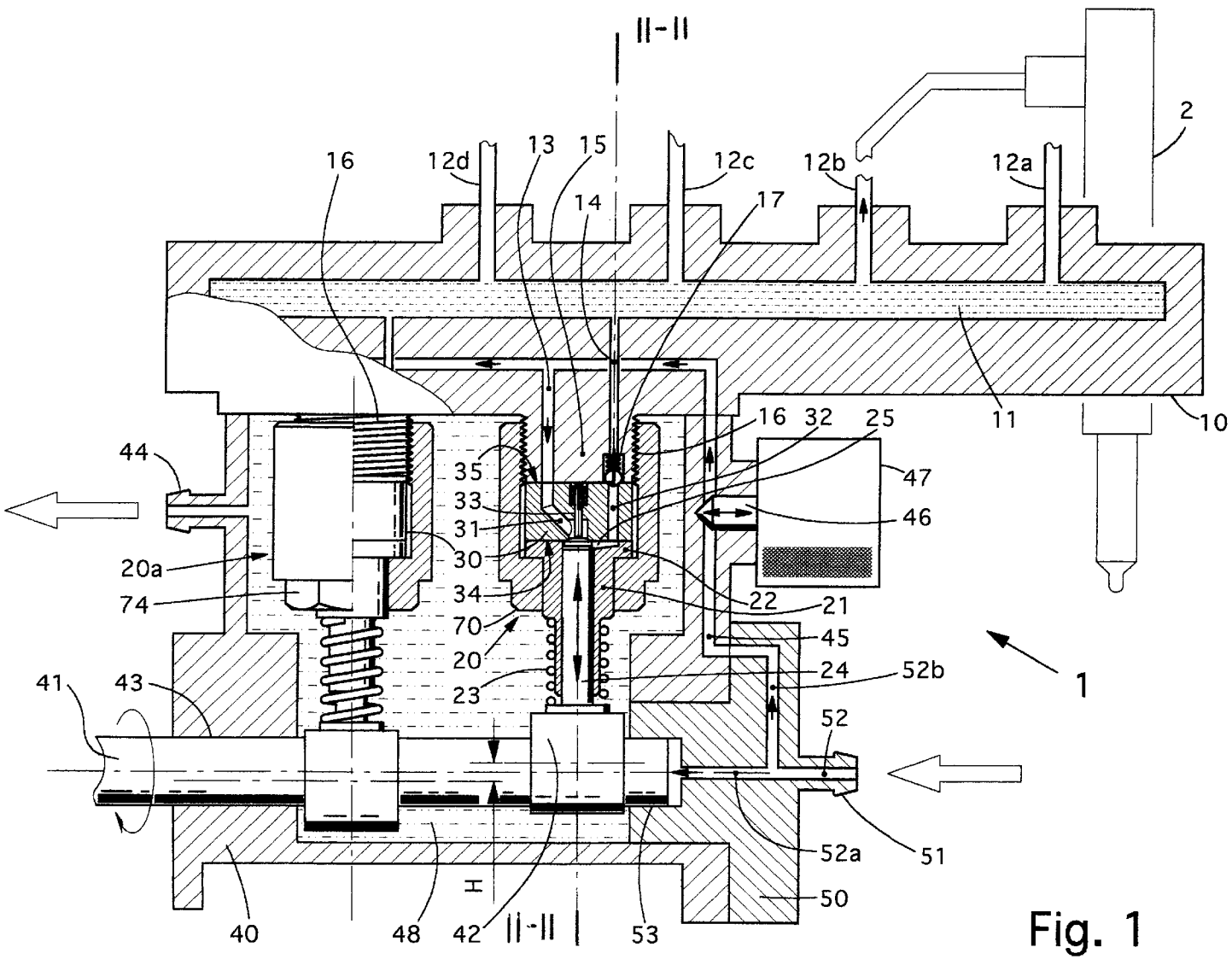
FIG. 1 shows a longitudinal section through a high-pressure injection system according to the invention, with port element, by means of which the plunger cylinder of a high-pressure pump is connected to a common rail.

The preferred embodiments will now be described with reference to the accompanying drawings, wherein like reference numerals designate corresponding or identical elements throughout the various drawings.

The high-pressure injection system 1 according to the invention shown in the longitudinal section in FIG. 1 has two high-pressure pumps 20 and 20*a* running in parallel. The first high-pressure pump 20 represented in the section is provided with a plunger cylinder 21 having a flange 22, in which a plunger 24, pressed by a spring element 23 against a rolling contact ring 42 eccentrically arranged on a drive shaft 41, is displaceably supported. The lift of the plunger 24 is denoted by H in FIG. 1.

A port element 30, which has end faces 34 and 35, designed as high-pressure sealing surfaces and facing the plunger cylinder 21 and a high-pressure line element, for example, a common rail 10, is arranged on the outlet side of the plunger cylinder 21. An inlet port 31 and an outlet port 32, which are connected to corresponding admission and discharge ports 13, 14 respectively in the common rail 10, run between the first end face 34 and the second end face 35. A pumped medium can be fed to the inlet port by way of the admission port 13. The discharge port 14 is connected to a pressure chamber 11 provided in the common rail 10, from which chamber connecting lines 12*a*, 12*b*, 12*c*, 12*d* are each led to an injector 2.

For opening and closing the inlet port 31 and the outlet port 32, an inlet valve 33 and an outlet valve 17 are provided. The inlet valve 33 and the outlet valve 17 are drawn or pressed by spring elements against the corresponding openings of the ports 31, 32.

The common rail 10 has a formed-on part 15 provided with a thread 16 for each of the high-pressure pumps 20; 20*a*. The formed-on part 15 is provided on the end face with a high-pressure sealing surface, to which the second end face 35 of the port element 30 is connected in such a way that the inlet and outlet ports 31, 32 are connected into the admission and discharge ports 13, 14 respectively in the common rail 10.

Figure 2:
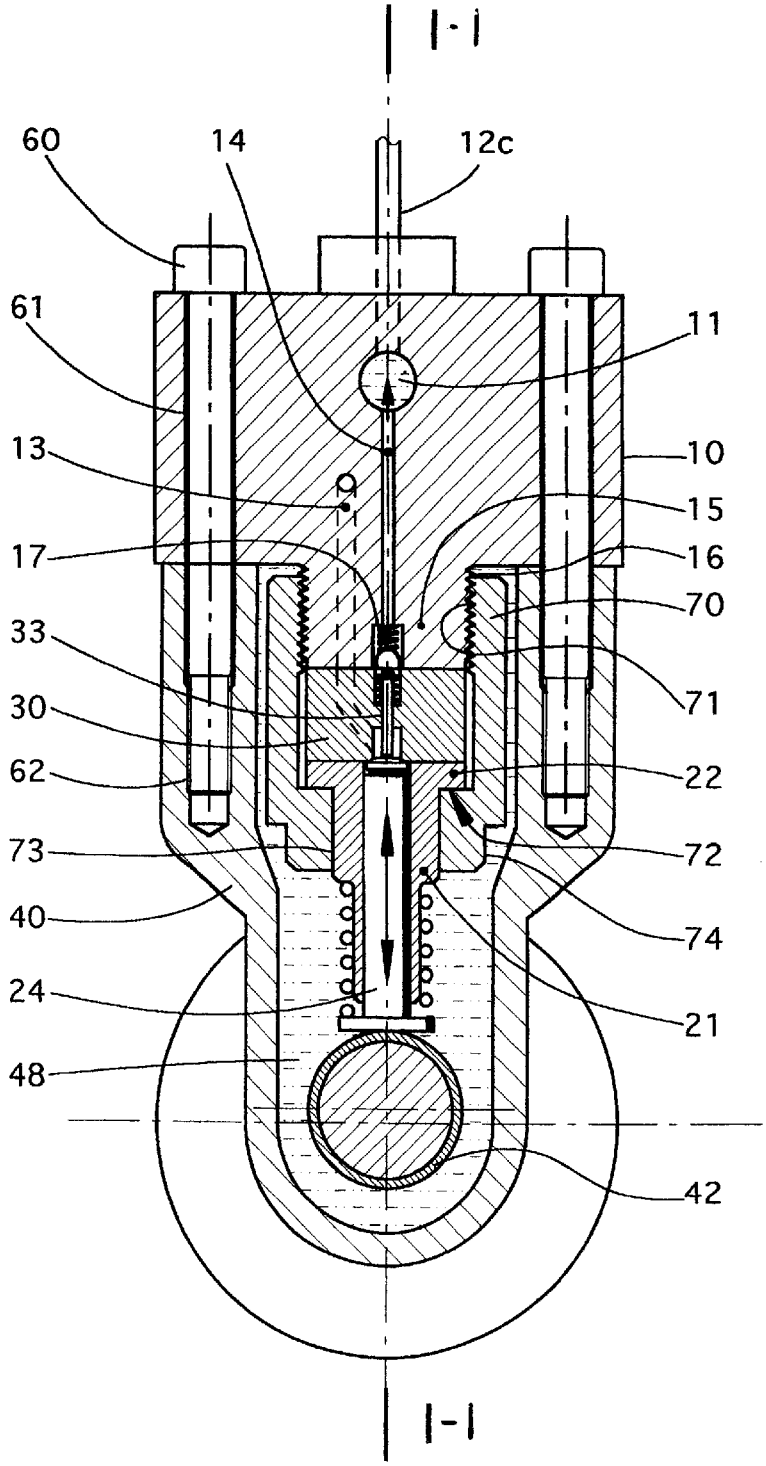
FIG. 2 shows a cross section through the high-pressure injection system in FIG. 1 along the line II—II.

The formed-on part 15 is screw-fastened to a union nut 70 having an internal thread and an opening 73, which serves to accommodate the plunger cylinder 21 (see FIG. 2). The flange 22, provided on the plunger cylinder 24 on the outlet side and having a high-pressure sealing surface facing the port element 30, is held by the union nut 70 through an inner flange 72 and drawn against the first end face 34 of the port element 30. The port element 30 is therefore clamped between the plunger cylinder 21 and the common rail 10 by the union nut 70. In order to allow the union nut 70 to be grasped by a tool, it has a hexagonal shape 74, for example, at the bottom end.

The high-pressure pumps 20, 20*a* are arranged in a housing 40 connected to the common rail 10 and tightly sealed by a cover 50. The drive shaft 41 provided for driving the plunger 24 is led into the housing 40 where it is supported in each of the bearings 43, 53 provided in the housing 40 and in the cover 50, respectively.

In the cover 50, a port 52, connected to a connection 51, is provided. The port 52 branches into two subsidiary ports 52*a* and 52*b*, of which the first subsidiary port 52*a* leads to the bearing 53 and thence into the housing inner chamber 48, and the second subsidiary port 52*b* to a transfer port 45 provided in the housing 50, which transfer port connects the second subsidiary port 52*b* to the admission port 13 carried in the common rail 10.

The flow rate of the pumped medium fed to the connection 51 by a feed pump (not shown here) is controlled by an intake throttle valve 46 projecting into the transfer port 45, in which valve is connected to an adjusting element 47 fitted to the housing 40. This arrangement does not require any additional components, merely a corresponding design of the receiver section on the housing 40. The pumped medium fed into the housing inner chamber 48 that serves for lubrication of the drive shaft 41 and the plunger 24 is led away from the housing 40 through an outlet connection 44 together with any pumped medium that may have escaped in small quantities from the high-pressure pumps 20, 20*a*.

The high-pressure injection system 1 shown in FIG. 1 functions as follows. To downstream of the intake throttle valve 46, the pumped medium flows by way of the transfer port 45, the admission port 13 provided in the common rail 10 and the inlet port 31 provided in the port element 30 to the inlet valve 33, which opens as soon as the pressure in the inner chamber of the plunger cylinder 21 falls when the plunger 24 runs out. When the plunger 24 runs in, the pumped medium drawn into the inner chamber 25 of the plunger cylinder 21 is on the one hand forced against the inlet valve 33, which closes the inlet port 31, and on the other is fed by way of the outlet port 32 of the port element 30 to the outlet valve 17, which opens and allows the pumped medium to pass to the pressure chamber 11 of the common rail 10. Pumped medium is therefore introduced into the pressure chamber 11 of the common rail 10 as a function of the speed of rotation of the drive shaft 41.

FIG. 2 shows a cross section through the high-pressure injection system 1 along the line II—II entered in FIG. 1. From this, it can be seen that the common rail 10 is connected to the housing 40 by means of bolts 60, which are screwed in through holes 61 in the common rail 10 into tapped holes 62 in the housing 40. Also clearly visible is the assembly of the plunger cylinder 21 and the port element 30, which are gripped and held by the union nut 70 connected to an internal thread 71 by the external thread 16 of the formed-on part 15. It is particularly advantageous that the pre-tensioning force for sealing of the connections produced at the end faces 34, 35 of the port element 30 is transmitted to the outer flange 22 of the plunger cylinder 21 by the inner flange 72 of the union nut 70 uniformly over the entire circumference. The resulting sealant-free seals at the end faces 34, 35 of the port element 30 prevent fluids penetrating through the joints of the components connected to one another. An increase in the surface pressure serving to close or reduce the existing joints permits a further improvement of the sealing, so that the high-pressure injection system 1 can operate with higher liquid pressures.

Figure 3A:
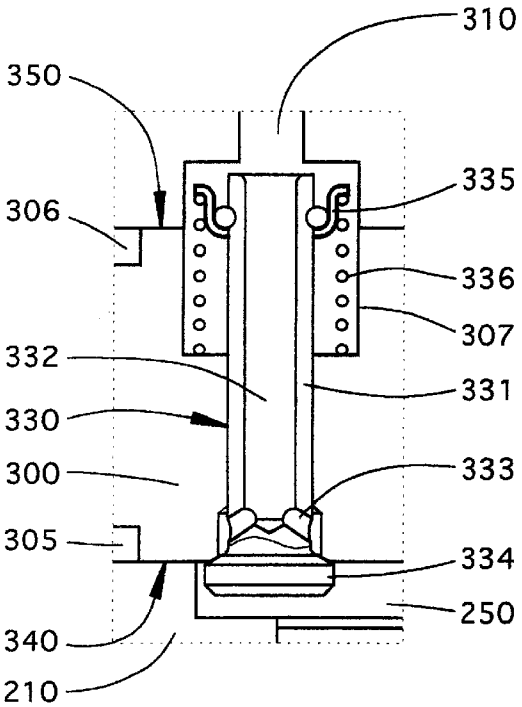
FIG. 3*a* shows an enlargement of the inlet valve provided with a hollow stem represented in FIG. 3.
Figure 3:
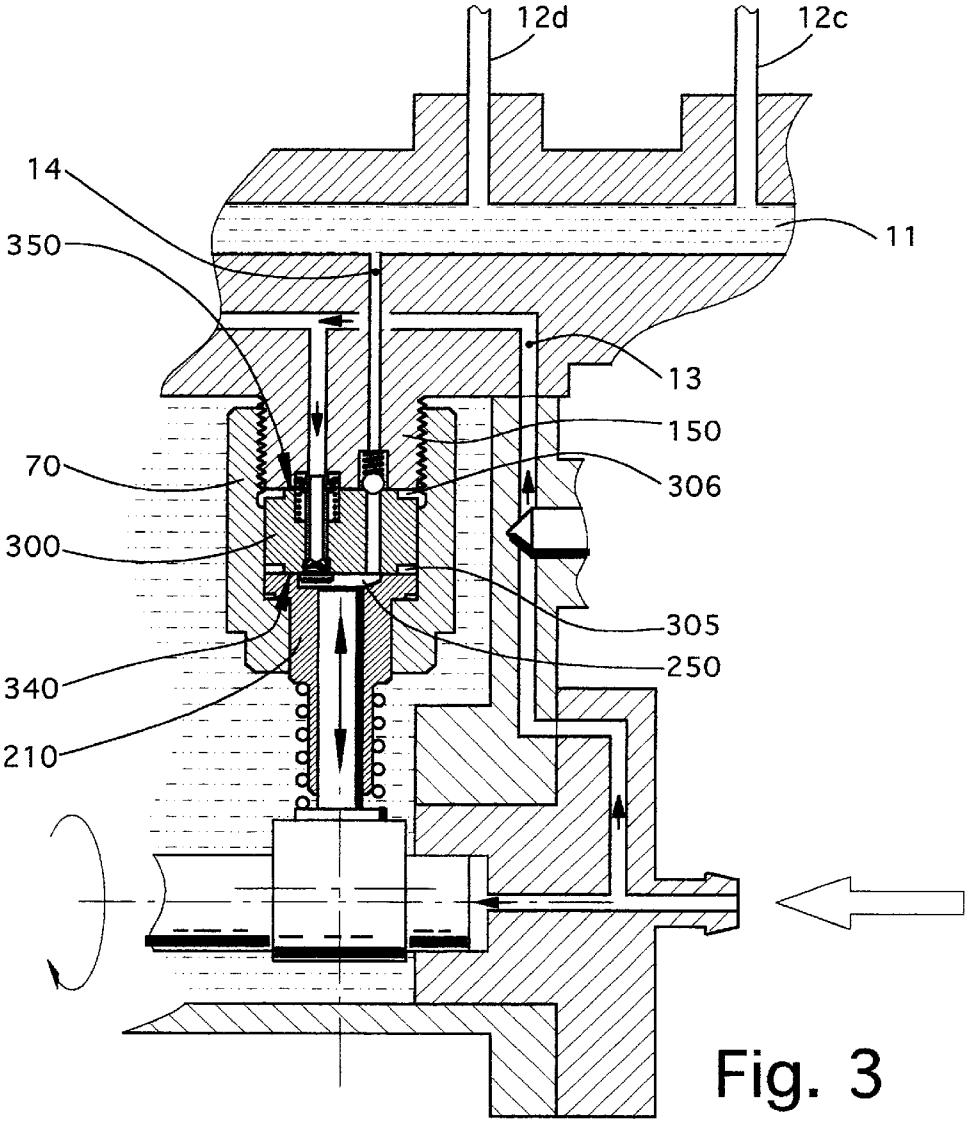
FIG. 3 shows a longitudinal section through a preferred embodiment of the port element and an inlet valve.
Figures 4, 4A, 5, 5A:
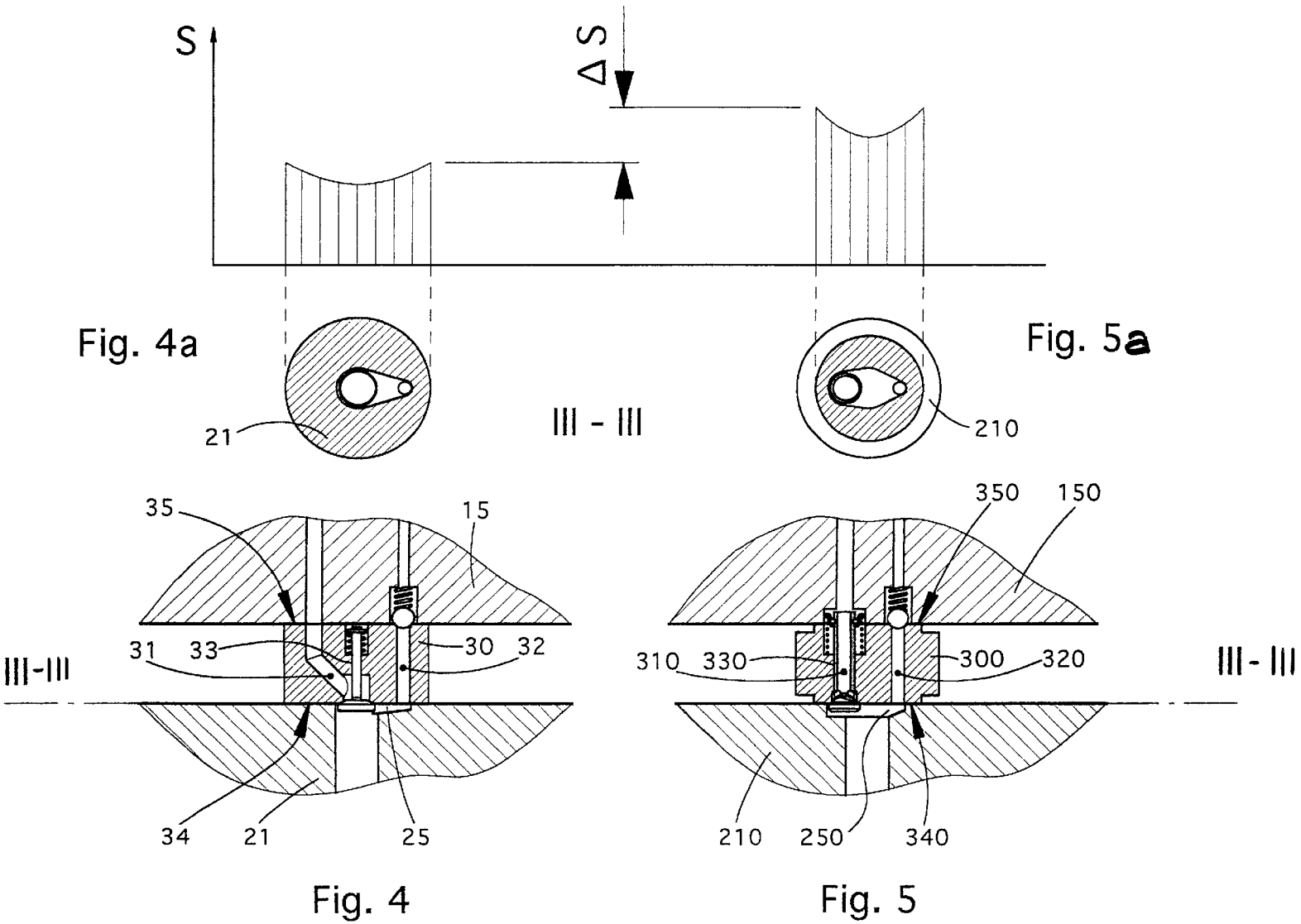
FIG. 4 shows the port part in FIG. 1 with centrally arranged inlet valve.
FIG. 4*a* shows the end face, facing the port part, of the plunger cylinder in FIG. 1 together with the gradient of the surface pressure on this end face.
FIG. 5 shows the port part in FIG. 3 with laterally offset inlet valve.
FIG. 5*a* shows the end face, facing the port part, of the plunger cylinder in FIG. 1 together with the gradient of the surface pressure on this end face.

An increase in the surface pressure is advantageously obtained by the port element 300, of preferred design shown in FIG. 3 and FIG. 5. The increase in the surface pressure is obtained by reducing the connection surfaces of the components connected to one another. As shown in FIG. 3 and FIG. 5, the connection surfaces provided at the end faces 340, 350 of the port element 300 are preferably reduced. This is done, for example, by sinking circular grooves 305, 306 into the port element 300, preferably at the edges of the end faces 340, 350. The end faces of the adjoining components 15, 21 can obviously also be correspondingly machined. The differing gradient for the surface pressures at the connecting points for the two different designs of the port part 30; 300 can be seen from FIG. 4*a* and FIG. 5*a*, in which the end faces of the plunger cylinder 21; 210 are adapted to the port elements 30; 300. A distinctly higher surface pressure and hence an improved sealing of the connecting points is obtained for the port part 300 of preferred design.

In reducing the surfaces of the end faces 340, 350 of the port element 300 account must naturally be taken of the ports 31, 32 and valves 33 provided therein. Centering or shifting these parts 31, 32, 33 into the center of the end faces 34, 35 of the port element 30 (see FIG. 5) allows wider grooves 305 to be made in the end faces 34, 35 and the surface pressure to be increased further.

The arrangement of the inlet valve 330 shown in FIG. 3*a* inside the inlet port 310 permits a more advantageous centering of the ports 310, 320 of the port element 300, since no additional space is needed for the inlet valve 330. A comparison of the port elements 30, 300 in FIG. 4 and FIG. 5 furthermore shows that the course of the inlet port 310 provided with the inlet valve 330 is clearly simplified, resulting in a reduction in the manufacturing cost of the port element 300.

The inlet valve 330 shown in FIG. 3*a* has a hollow stem 331 provided with a port 332. The inner chamber 332 of the hollow stem or inlet valve 330 is connected by openings 333 to the inner chamber 250 of the plunger cylinder 210 as soon as the ram 334 is lifted off from its bearing surface, so that the fluid can pass into the cylinder chamber 250 as the plunger 24 descends. The inlet valve 330, which has a mount 335 on the side remote from the ram 334, the mount being drawn upwards by a valve spring 336 inserted in a cylindrical expansion 307 of the inlet port 310, may also be used advantageously in other delivery systems independently of the high-pressure injection system described above.

Various valves can also be used for the high-pressure injection system 1 described above. It is possible to accommodate all or part of the outlet valve 17, provided in the formed-on part, in the port element 30 or the port element 300.

Figure 6:
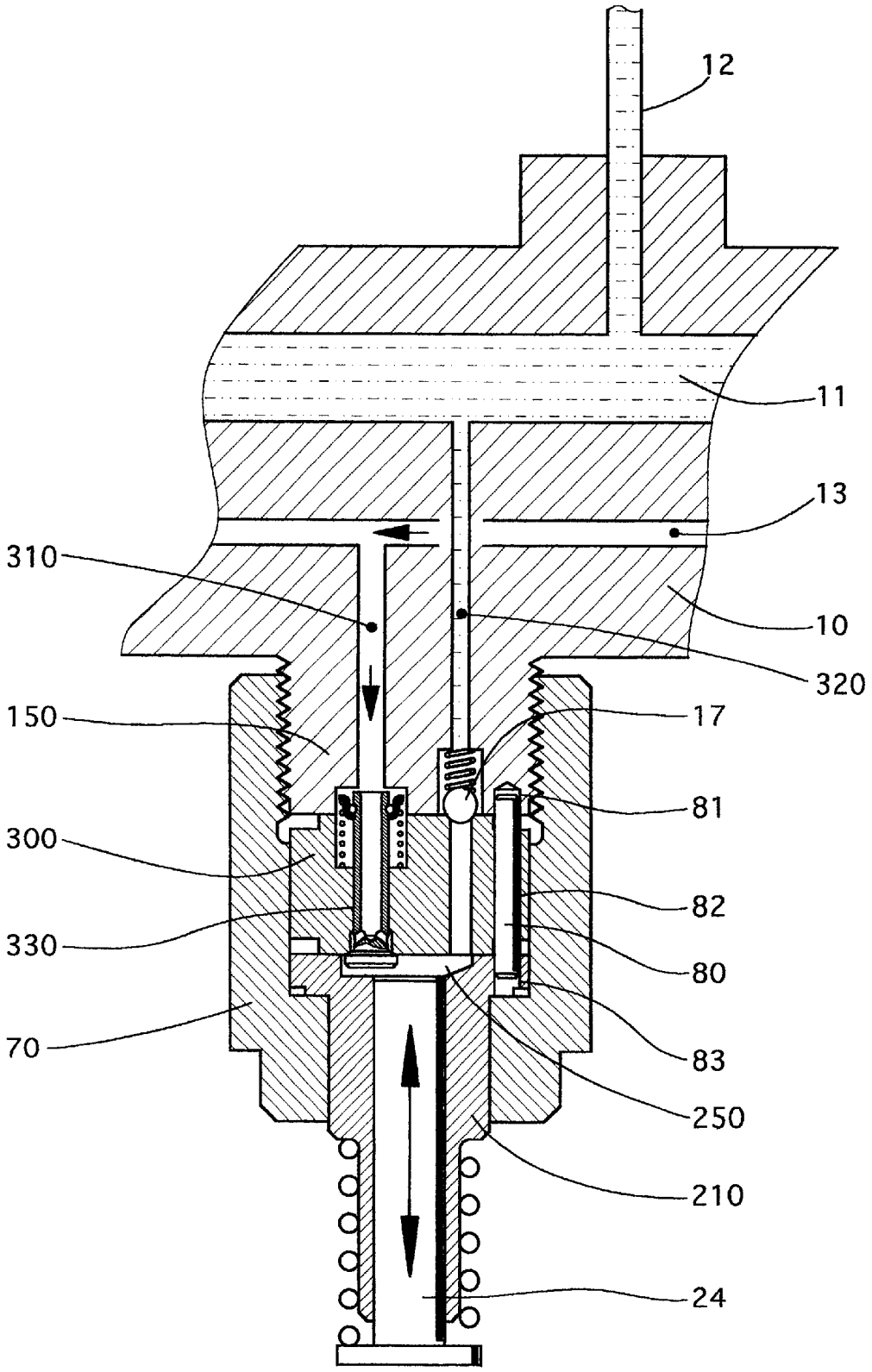
FIG. 6 shows the port part in FIG. 3 provided additionally with a pin.

For ease of assembly and precise adjustment in relation to the formed-on part 15; 150 and to the plunger cylinder 21; 210 the port element 30; 300 may be provided with one or more pins 80, is shown in FIG. 6 are inserted in holes 81, 82, 83, which are provided in the formed-on part 15; 150, in the port element 30; 300 and in the plunger cylinder 21; 210.

Only port elements 30, 300 that have an inlet valve 31; 310 and an outlet valve 32; 320 are represented in the drawings. The invention can, however, also be used in systems in which fuel is fed to the high-pressure pump 20 not by way of the common rail and the port element, but through a line directly connected to the high-pressure pump 20, for example.

Figure 1A:
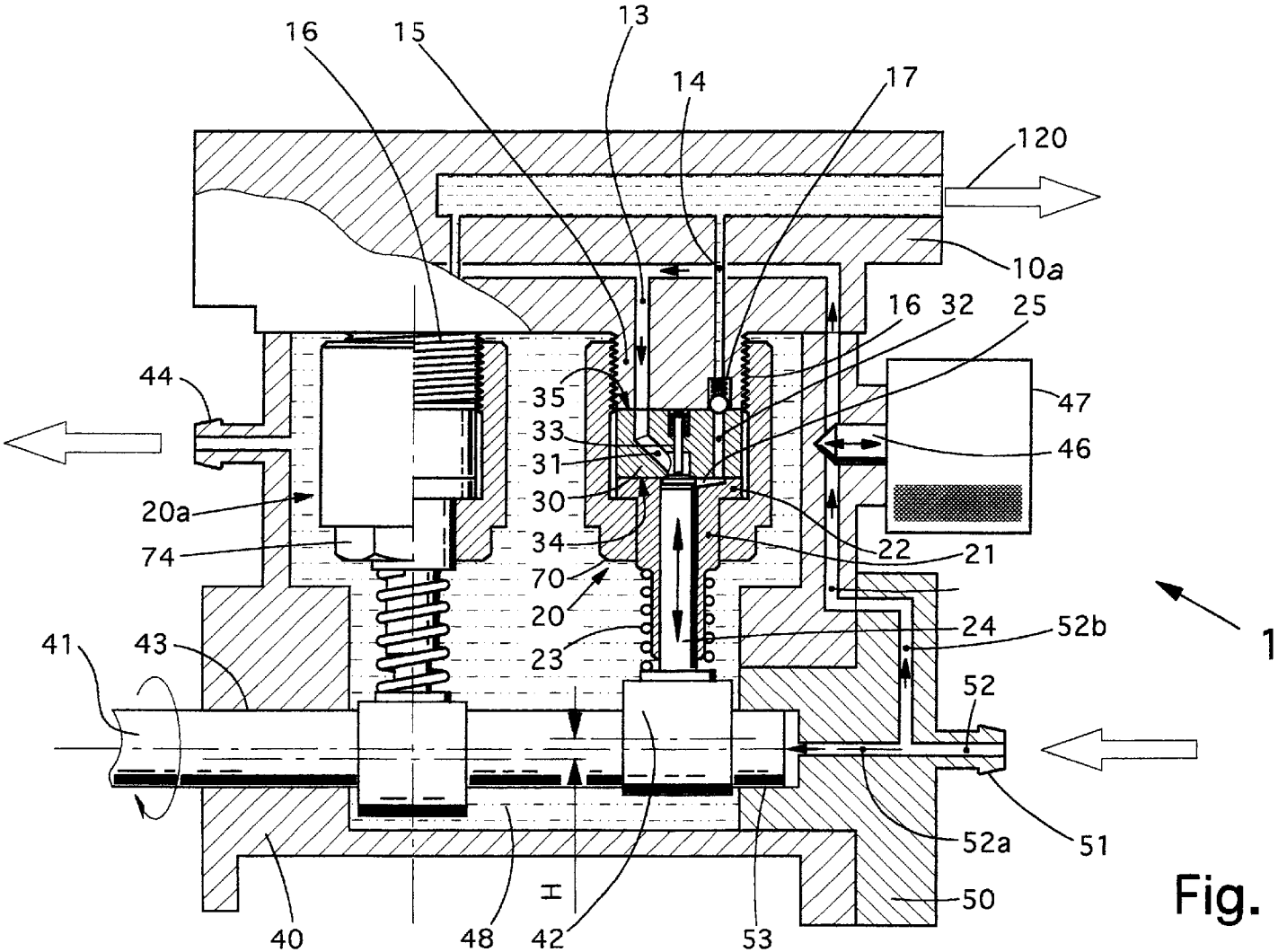
FIG. 1*a* shows the high-pressure injection system with a high-pressure line element 10*a* of preferred short design, which has a high-pressure outlet 120.

As shown in FIG. 1*a*, the high-pressure injection system 1 according to the present invention can advantageously be used with various types of common rails or high-pressure line elements. The high-pressure line element 10*a* shown there has a shortened body and a high-pressure outlet 120.

The high-pressure injection system according to the present invention has a port element provided with at least one outlet port, with opposing end faces, to which a plunger cylinder of a high-pressure pump on the one hand and a high-pressure line element on the other are connected by way of high-pressure sealing surfaces, so that the high-pressure pump can draw in the pumped medium by way of an inlet valve and can introduce it at increased pressure through the outlet port of the port element and an outlet valve into a discharge port connected to a pressure chamber in the high-pressure line element.

The high-pressure injection system according to the present invention has a port element provided with at least one outlet port, with opposing end faces, to which a plunger cylinder of a high-pressure pump on the one hand and a common rail on the other are connected by way of high-pressure sealing surfaces, so that the high-pressure pump can draw in the pumped medium by way of an inlet valve and can introduce it at increased pressure through the outlet port of the port element and an outlet valve into a discharge port connected to a pressure chamber in the common rail.

The high-pressure injection system according to the present invention, suitable for operation at very high pressures, is of simple construction and can therefore be manufactured, fitted and serviced at low cost.

It is particularly advantageous, for example, for the port element to be clamped between plunger cylinder and high-pressure line element by means of a union nut, so that further fixing measures are not necessary. In order to avoid the task of adjusting the port element in relation to the plunger cylinder and high-pressure line element, at least one pin, which ensures correct alignment of the connected parts with one another, is preferably inserted into the port element.

In a preferred embodiment inlet ports are also provided in the high-pressure line element and the port element, through which a pumped medium or fuel can be fed to the high-pressure pump. The high-pressure sealing surfaces provided at the end faces of the port element at the same time therefore ensure a tight connection of the inlet ports, thereby further reducing the cost of assembly and servicing.

The plunger cylinder and port element are preferably assembled by means of a union nut that can be screwed to the high-pressure line element.

In a preferred embodiment inlet ports are also provided in the common rail and the port element, through which a pumped medium or fuel can be fed to the high-pressure pump. The high-pressure sealing surfaces provided at the end faces of the port element at the same time therefore ensure a tight connection of the inlet ports, thereby further reducing the cost of assembly and servicing.

The plunger cylinder and port element are preferably assembled by means of a union nut that can be screwed to the common rail.

In order to reduce the high-pressure sealing surfaces and therefore increase the surface pressure of the sealing surfaces, resulting in improved sealing, the end faces of the port element are correspondingly stepped. In addition, an inlet valve provided with a hollow stem is preferably used, which can be fitted inside the inlet port.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. A high-pressure injection system for internal combustion engines, comprising:

a high-pressure pump having a plunger cylinder, the plunger cylinder having a delivery chamber and a high-pressure sealing surface on an outlet side;

a port element arranged on the outlet side of the plunger cylinder and having a first end face and a second end face, the port element having an outlet port flow-connected to the delivery chamber and an outlet valve, the first end face of the port element facing the plunger cylinder; and a high-pressure line element arranged on an outlet side of the port element, wherein:

the high-pressure line element comprises a high-pressure sealing surface, the high-pressure line element bears against the second end face of the port element;

the port element is clamped between the plunger cylinder and the high-pressure line element; and the first and second end faces of the port element each comprise a high-pressure sealing surface.

2. The high-pressure injection system as claimed in claim 1, wherein the plunger cylinder is fastened to the high-pressure line element by a fixing element positioned and configured to surround the port element and to grip the plunger cylinder and the high-pressure line element.

3. The high-pressure injection system as claimed in claim 2, wherein:

the fixing element comprises a union nut having an internal thread and an inner flange; and the inner flange grips the plunger cylinder and the internal thread is screwed into the high-pressure line element.

4. The high-pressure injection system as claimed in claim 3, wherein:

the high-pressure line element has a cylindrical formed-on part having a front face and an external thread;

the high-pressure sealing surface of the high-pressure line element is formed on the front face of the cylindrical formed-on part; and the external thread is configured to act in association with the internal thread provided in the union nut.

5. The high-pressure injection system as claimed in claim 1, wherein:

the plunger cylinder has a cylinder chamber;

the delivery chamber is arranged in the cylinder chamber of the plunger cylinder and is defined on the outlet side by the first end face of the port element.

6. The high-pressure injection system as claimed in claim 1, wherein:

the port element has an inlet port extending between the first and second end faces; and the inlet port is connected to an admission port running in the high-pressure line element and to the delivery chamber.

7. The high-pressure injection system as claimed in claim 6, wherein:

at least one of the inlet port and the outlet port of the port element is provided with a valve; and the valve has a hollow stem suitable for ducting of a pumped medium and a plurality of outlet openings connecting thereto.

8. The high-pressure injection system as claimed in claim 4, wherein:

the first end face of the port element and the plunger cylinder have a reduced contact surface therebetween; and the second end face of the port element and the cylindrical formed-on part of the high-pressure line element have a reduced contact surface therebetween.

9. The high-pressure injection system as claimed in claim 1, further comprising a housing tightly connected to the high-pressure line element and having a housing inner chamber, wherein the high-pressure pump and at least part of a drive thereof are arranged in the housing inner chamber.

10. The high-pressure injection system as claimed in claim 9, wherein the housing inner chamber is configured to introduce a pumped medium for lubrication of the drive and the high-pressure pump.

11. The high-pressure injection system as claimed in claim 10, wherein the pumped medium is a portion of fuel for the internal combustion engine.

12. The high-pressure injection system as claimed in claim 9, further comprising a throttle element provided with an adjusting element, wherein the housing has a transfer port in a wall of the housing, the transfer port is connected to the admission port carried in the high-pressure line element, and a flow rate of the pumped medium is controlled by the throttle element with the adjusting element.

13. The high-pressure injection system as claimed in claim 4, wherein the plunger cylinder, the port element and the formed-on part each are provided with a hole configured to receive a pin serving for alignment.

14. The high-pressure injection system as claimed in claim 1, further comprising:

a housing configured to encase the high-pressure pump and at least part of a drive thereof;

a transfer port for a pumped medium provided in a wall of the housing and connected to the delivery chamber; and an intake throttle element having an intake throttle valve and an adjusting element, the intake throttle element is positioned and configured to control a flow rate of the pumped medium in the transfer port with the intake throttle valve and the adjusting element.

15. A high-pressure line element for a high-pressure injection system, comprising:

a pressure chamber serving for storage of a pumped medium which is fed into the pressure chamber by a high-pressure pump and fed from the pressure chamber to a plurality of injectors inserted into the internal combustion engine; and at least one cylindrical formed-on part configured to be connected to a high-pressure pump and having an admission port and a discharge port, the admission port being configured to feed the pumped medium carried in the high-pressure line element to the high-pressure pump, the discharge port being configured to receive the pumped medium from the high-pressure pump to the pressure chamber.

16. The high-pressure injection system as claimed in claim 1, wherein the high-pressure line element comprises a common rail with the high pressure sealing surface bearing against the second end face of the port element.

17. The high-pressure injection system as claimed in claim 4, wherein the high-pressure line element comprises a common rail with the high pressure sealing surface bearing against the second end face of the port element and having the cylindrical-formed on part.

18. The high-pressure injection system as claimed in claim 6, wherein the high-pressure line element comprises a common rail with the high pressure sealing surface bearing against the second end face of the port element, the admission port running in the common rail.

19. The high-pressure injection system as claimed in claim 8, wherein the high-pressure line element comprises a common rail with the high pressure sealing surface bearing against the second end face of the port element and having the cylindrical formed-on part.

20. The high-pressure injection system as claimed in claim 9, wherein the high-pressure line element comprises a common rail with the high pressure sealing surface bearing against the second end face of the port element, the housing being tightly connected to the common rail.

21. The high-pressure injection system as claimed in claim 12, wherein the high-pressure line element comprises a common rail with the high pressure sealing surface bearing against the second end face of the port element, the admission port being carried in the common rail.

* * * * *